US006211727B1

(12) United States Patent
Carobolante

(10) Patent No.: US 6,211,727 B1
(45) Date of Patent: Apr. 3, 2001

(54) CIRCUIT AND METHOD FOR INTELLIGENTLY REGULATING A SUPPLY VOLTAGE

(75) Inventor: Francesco Carobolante, Scotts Valley, CA (US)

(73) Assignee: STMicroelectronics, Inc., Carrollton, TX (US)

( * ) Notice: Subject to any disclaimer, the term of this patent is extended or adjusted under 35 U.S.C. 154(b) by 0 days.

(21) Appl. No.: 09/031,256

(22) Filed: Feb. 26, 1998

(51) Int. Cl.[7] ..... G05F 1/575; G05F 1/46
(52) U.S. Cl. ..... 327/543; 327/540; 323/282
(58) Field of Search ..... 327/541, 542, 327/543, 538, 540

(56) References Cited

U.S. PATENT DOCUMENTS 5,136,260 * 8/1992 Yousefi-Elezei ..... 327/272
5,399,958 * 3/1995 Iyoda ..... 323/282
5,528,125 * 6/1996 Marshall et al. ..... 323/282
5,546,043 * 8/1996 Pollmeier ..... 327/427
5,648,766 * 7/1997 Stengel et al. ..... 331/57
5,671,149 * 9/1997 Brown ..... 323/282
5,712,589 * 1/1998 Afek et al.. ..... 327/540
5,883,544 * 3/1999 So et al. ..... 327/537
5,945,820 * 8/1999 Namgoong et al. ..... 323/282

* cited by examiner

*Primary Examiner*—Timothy P. Callahan
*Assistant Examiner*—Terry L. Englund
(74) *Attorney, Agent, or Firm*—David V. Carlson; Theodore E. Galanthay; Lisa K. Jorgenson

(57) ABSTRACT

The intelligent power supply regulator is used to adjust a supply voltage until an adjusted supply voltage to a served device is at or near the optimal supply voltage of the served device and thereafter maintain the adjusted supply voltage at or near the optimal supply voltage. Depending on the application, the intelligent power supply regulator can comprise: (1) a sensing circuit, a discriminator circuit and a voltage regulating circuit for regulating the supply voltage; or (2) a sensing circuit and a discriminator circuit for controlling a voltage regulating circuit, which regulates the supply voltage. The sensing circuit is coupled to the served device so that at least one performance parameter of the served device can be continuously measured.

34 Claims, 2 Drawing Sheets

CIRCUIT AND METHOD FOR INTELLIGENTLY REGULATING A SUPPLY VOLTAGE

FIELD OF THE INVENTION

The present invention relates generally to a voltage regulator and more specifically to a circuit and method for intelligently regulating a supply voltage to a served device in which the supply voltage is regulated according to one or more performance parameters of the served device.

BACKGROUND OF THE INVENTION

The performance characteristics of a Complimentary Metallic Oxide Semiconductor ("CMOS") device are maximized when the device operates at a certain supply voltage (the "optimal supply voltage" $V_{OPT}$). Although the value of the optimal supply voltage for a CMOS device is specified when the device is designed (the "design voltage"), variations and imperfections in the manufacturing process cause the optimal supply voltage to vary from device to device. Moreover, when the CMOS device is placed in operation, the voltage supplied to the device is rarely equal to the optimal supply voltage, or even the design voltage. In fact, the supply voltage will likely vary over time as operating conditions change.

As a result of these variations, CMOS devices are designed to operate within a specified voltage range, such as plus or minus five to ten percent, around the design voltage. The bottom end of the specified voltage range is limited by the threshold voltage of the CMOS device, which is the minimum voltage required to operate the device. When the voltage supplied to the CMOS device is at or near the threshold level, the device will operate, but at a much slower speed. Conversely, the top end of the specified voltage range is limited by the reliability constraints of the CMOS device. When the voltage supplied to the CMOS device is at or near its maximum operating level, the device will operate at maximum speed, but its power dissipation will be excessive. Accordingly, the goal of any voltage regulation circuit should be to maintain the supply voltage to the CMOS device at or near the optimal supply voltage for the device. Most voltage regulators, however, maintain the supply voltage at or near the design voltage; not the optimal supply voltage.

As discussed above, the manufacture of integrated circuit devices is not 100% repetitive. That is, the geometry of each device varies due to imperfections and variations in the manufacturing process, which in turn affects the performance characteristics of the device. Although, these devices are designed to operate within a specified voltage range, these imperfections and variations may cause some of the devices to operate too slowly, dissipate too much power, or not operate at all, at the minimum or maximum specified voltage, thus making those devices unusable and thereby decreasing the production yield. Furthermore, the production yield for a given device decreases as its complexity increases.

One approach taken by some designers and manufacturers to increase production yield is to provide jumpers or programmable connections on the device to alter its performance so that it operates within the specified voltage range. This method, however, only provides a "coarse" adjustment and does not assure that the device will operate at its optimal level for a given voltage, and will not track the performance of the device, especially over temperature variations.

These problems are multiplied as circuit designers and manufacturers continue to decrease the overall geometry of CMOS devices because the design voltages and associated operating ranges are also decreased. For example, to achieve a certain gate length, such as 0.25 microns, the supply voltage cannot exceed 3.3 volts. If the gate length is decreased to 0.18 microns, the supply voltage cannot exceed 2.0 volts. This smaller voltage range will necessarily further decrease the production yield. Moreover, systems designers employing CMOS technologies often limit the devices they use based on a range of supply voltages. As the dimensions and supply voltages of these devices decrease, the devices themselves may become unattractive to designers who are limited in device selection based on system requirements.

Accordingly, it is desirable to have a circuit and method for intelligently regulating a supply voltage to a served device in which the supply voltage is regulated according to one or more performance parameters of the served device.

SUMMARY OF THE INVENTION

The present invention provides a circuit and method for intelligently regulating a supply voltage to a served device according to one or more performance parameters of the served device. More specifically, the present invention comprises a sensing circuit coupled to the served device for measuring at least one performance parameter of the served device and producing a performance signal which is representative of the measured parameter(s), a discriminator circuit for comparing the performance signal to a reference signal and producing a control signal, and a voltage regulating circuit for adjusting the supply voltage to the served device in response to the control signal.

The present invention also provides a circuit for intelligently controlling a voltage regulating circuit, which provides a supply voltage to a served device. In this embodiment, the present invention comprises a sensing circuit coupled to the served device for measuring at least one performance parameter of the served device and producing a performance signal which is representative of the measured parameter(s), and a discriminator circuit for comparing the performance signal to a reference signal and producing a control signal for controlling the voltage regulating circuit.

The present invention also provides a method for regulating a supply voltage to a served device. The method comprising the steps of measuring at least one performance parameter of the served device and producing a performance signal which is representative of the measured parameter(s), comparing the performance signal to a reference signal and producing a control signal, and regulating the supply voltage to the served device in response to the control signal.

One advantage of the present invention is that the served device operates at or near its optimal supply voltage. As a result, the served device operates at its required speed without unnecessary power dissipation. Another advantage of the present invention is that the production yield for the served device is increased because the question of whether the served device is usable is determined by the performance of the served device and the ability of the present invention to regulate the supply voltage, rather than the performance of the served device over a specified voltage range.

Other objects, features and advantages of the present invention shall be apparent to those of ordinary skill in the art upon reference to the following detailed description taken in conjunction with the accompanying drawings. For example, although CMOS devices are described, the present invention can be applied to other types of semiconductor devices, as well as other electrical devices.

BRIEF DESCRIPTION OF THE DRAWINGS

The above and further advantages of the invention may be better understood by referring to the following description in conjunction with the accompanying drawings, in which.

DETAILED DESCRIPTION

Figure 1:
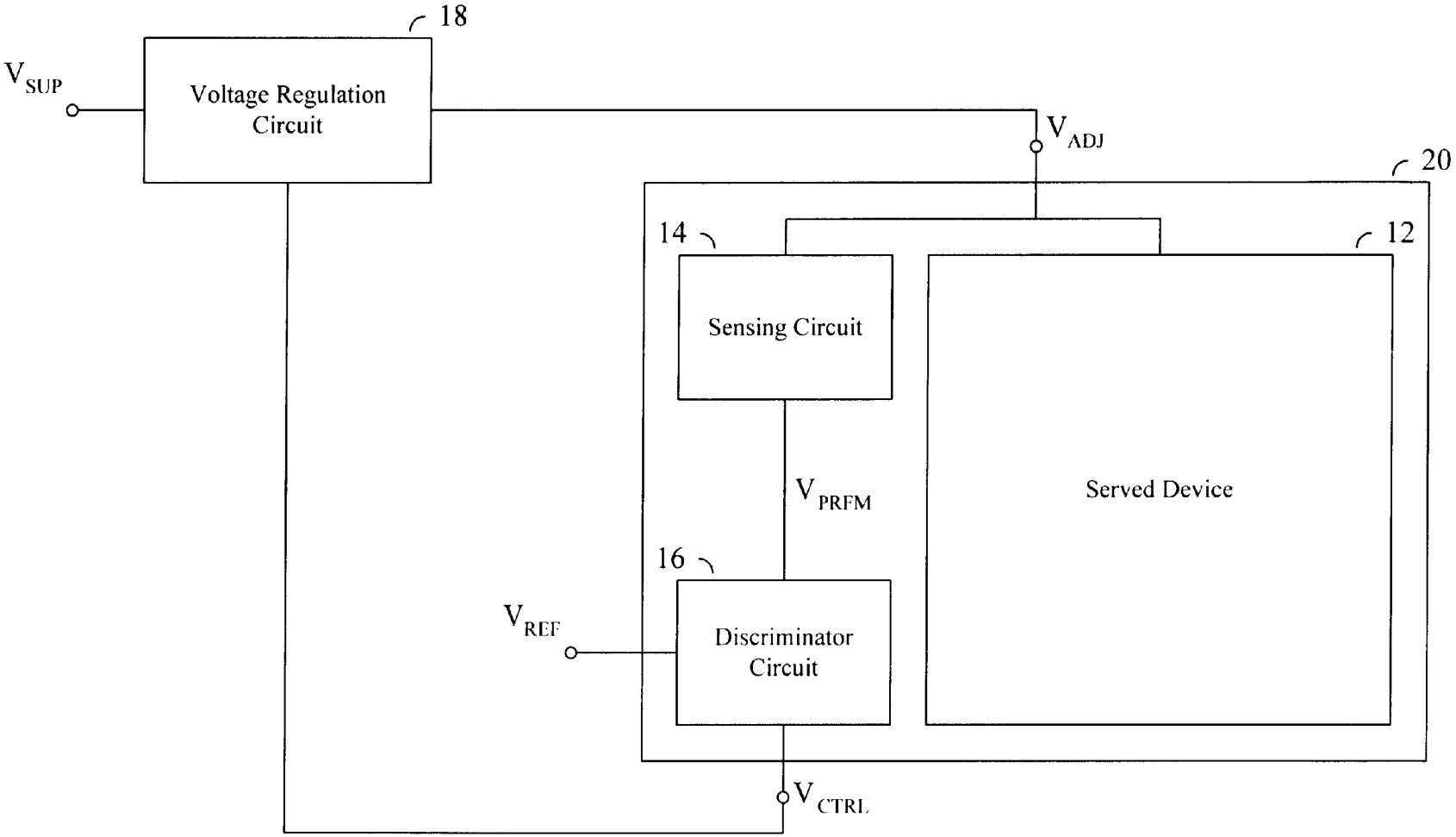
FIG. 1 is a block diagram of an intelligent supply voltage regulator in accordance with one embodiment of the present invention.

Referring now to the Drawings, and first to FIG. 1, a block diagram of an intelligent power supply regulator in accordance with one embodiment of the present invention is illustrated. In this embodiment, the present invention is used to adjust a supply voltage $V_{SUP}$ until an adjusted supply voltage $V_{ADJ}$ to a served device 12 is at or near the optimal supply voltage $V_{OPT}$ of the served device 12. Once the adjusted supply voltage $V_{ADJ}$ is at or near the optimal supply voltage $V_{OPT}$, the present invention continues to measure the performance parameters of the served device 12 and adjust the supply voltage $V_{SUP}$ as is necessary to maintain the adjusted voltage $V_{ADJ}$ at or near the optimal supply voltage $V_{OPT}$ at all times despite operating and temperature variations.

The intelligent power supply regulator comprises a sensing circuit 14, a discriminator circuit 16 and a voltage regulating circuit 18. The sensing circuit 14 is coupled to the served device 12 so that at least one performance parameter of the served device 12 can be continuously measured. Since the performance parameters are continuously measured, the adjusted voltage $V_{ADJ}$ can be maintained at or near the optimal supply voltage $V_{OPT}$ despite operating and temperature variations. The sensing circuit 14 then produces a performance signal $V_{PRFM}$ representative of the measured parameter(s).

A performance parameter can be any measurable property of the served device 12 that varies with a change in the adjusted supply voltage $V_{ADJ}$. For example, the optimal supply voltage $V_{OPT}$ for the served device 12 can be determined by measuring the transconductance of the served device 12.

The method of coupling the sensing circuit 14 to the served device 12 will depend upon the parameter(s) to be measured, and the physical and functional properties of the served device 12. For example, a sensing circuit 14 fabricated on the same integrated circuit 20 as the served device 12 can measure the physical performance properties of the integrated circuit 20 without being directly connected to the served device 12.

As will be understood by those skilled in the art, the physical location of the sensing circuit 14, the discriminator circuit 16 and the voltage regulation circuit 18 will depend upon the performance parameters that are to be measured and the operating characteristics and/or functionality of the served device 12. For example, in most lower power integrated circuits, such as CMOS, it is either not possible or not feasible to incorporate the voltage regulation circuit 18 in the same integrated circuit 20 as the served device 12 because of the power dissipation of the voltage regulation circuit 18. Yet, some circuit technologies may allow or make it advantageous to incorporate the voltage regulating circuit 18, the sensing circuit 14, the discriminator circuit 16, and the served device 12 into a single device or circuit (not shown). So except as described herein, the present invention is not limited by the physical location of the sensing circuit 14, the discriminator circuit 16, or the voltage regulating circuit 18.

The discriminator circuit 16 compares the performance signal $V_{PRFM}$ with a reference signal $V_{REF}$ and produces a control signal $V_{CRTL}$. The discriminator circuit 16, depending on the parameters measured, may contain additional circuitry to modify the performance signal $V_{PRFM}$ and/or reference signal $V_{REF}$ so that the two signals can be properly compared and a result determined. Moreover, additional control circuitry may be included to ensure that the control signal $V_{CRTL}$ is compatible with and properly controls the voltage regulating circuit 18.

The control signal $V_{CRTL}$ is used to control the voltage regulating circuit 18 so that the supply voltage $V_{SUP}$ is adjusted until the adjusted supply voltage $V_{ADJ}$ is at or near the optimal supply voltage $V_{OPT}$ of the served device 12. Thereafter, the control signal $V_{CRTL}$ is used to maintain the adjusted voltage $V_{ADJ}$ at or near the optimal supply voltage $V_{OPT}$ despite operating and temperature variations.

Still referring to FIG. 1, another embodiment of the present invention is used to control an existing or off-the-shelf voltage regulating circuit 18, which adjusts the supply voltage $V_{SUP}$ to provide the adjusted supply voltage $V_{ADJ}$. This embodiment also continuously maintains the adjusted voltage $V_{ADJ}$ at or near the optimal supply voltage $V_{OPT}$ despite operating and temperature variations. In this case, the intelligent power supply regulator comprises a sensing circuit 14 and a discriminator circuit 16. Otherwise, this embodiment functions in the same manner as previously described.

Figure 2:
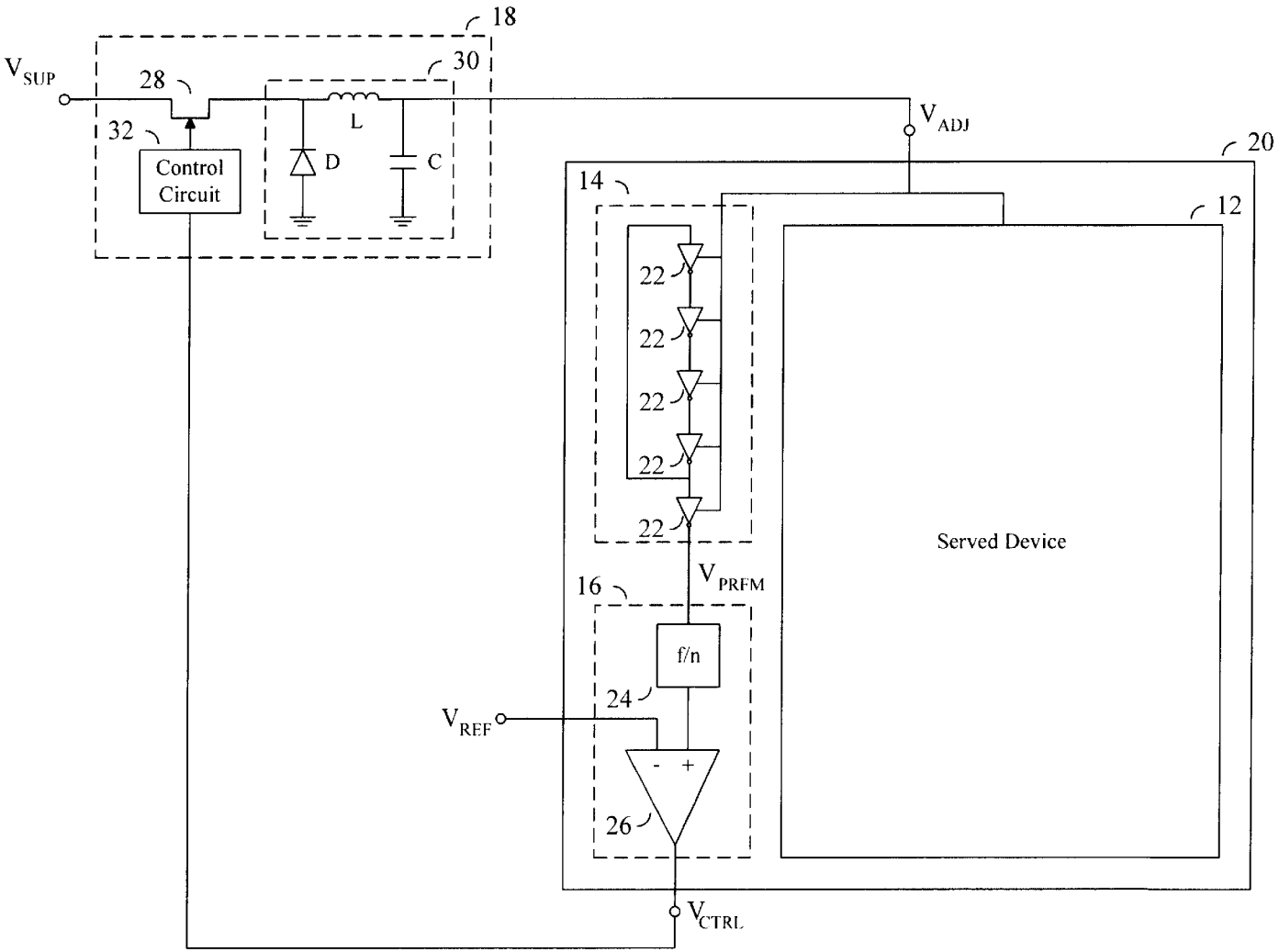
FIG. 2 is a circuit diagram of an intelligent supply voltage regulator in accordance with one embodiment of the present invention.

Now referring to FIG. 2, another embodiment of the present invention is illustrated. As previously described, the intelligent power supply regulator comprises a sensing circuit 14, a discriminator circuit 16 and a voltage regulating circuit 18. The served circuit 12, the sensing circuit 14 and the discriminator circuit 16 are all located on the same integrated circuit 20.

The sensing circuit 14 is designed to measure the transconductance of the served device 12 so that the supply voltage $V_{SUP}$ can be adjusted until the adjusted supply voltage $V_{ADJ}$ is at or near the optimal supply voltage $V_{OPT}$ for the served device 12. The sensing circuit 14 continuously measures the transconductance using a ring oscillator circuit, which is an odd number of series-connected invertors 22 biased by the adjusted supply voltage $V_{ADJ}$ and having a feedback loop. Since the transconductance of the served device 12 is continuously measured, the adjusted voltage $V_{ADJ}$ can be maintained at or near the optimal supply voltage $V_{OPT}$ despite operating and temperature variations. The ring oscillator circuit (sensing circuit 14) produces a signal $V_{PRFM}$ that oscillates at a frequency relative to the transconductance, a performance characteristic, of the served device 12. The output of the ring oscillator (sensing circuit 14) is connected to the discriminator circuit 16.

The discriminator circuit 16 comprises a frequency divider circuit 24 and a frequency discriminator circuit 26. The frequency divider circuit 24 reduces the frequency generated by the ring oscillator circuit (sensing circuit 14) to a frequency that can be conveniently compared to a reference frequency $V_{REF}$, such as an external clock. The frequency discriminator circuit 26 compares the performance signal $V_{PRFM}$ with the reference signal $V_{REF}$ and produces a control signal $V_{CRTL}$, which is connected to the control circuit 32 of the voltage regulating circuit 18.

The voltage regulating circuit 18, which can be a switched mode voltage regulator, is connected to a battery or some other unregulated supply voltage $V_{SUP}$. Typically the voltage regulating circuit 18 will contain a power transistor 28, a passive regulation circuit 30, which contains elements D, L and C, and a control circuit 32. The control circuit 32, in response to the control signal $V_{CRTL}$ from the frequency discriminator 16, adjusts the supply voltage $V_{SUP}$ until the adjusted supply voltage $V_{ADJ}$ is at or near the optimal supply voltage $V_{OPT}$ for the served device 12 and thereafter maintains the adjusted supply voltage $V_{ADJ}$ at or near the optimal supply voltage $V_{OPT}$.

Although preferred embodiments of the invention have been described in detail, it will be understood by those skilled in the art that various modifications can be made therein without departing from the spirit and scope of the invention as set forth in the appended claims.

What is claimed is:

1. An intelligent supply voltage regulator to adjust a supply voltage to a served device, comprising:

a sensing circuit fabricated of transistors on a same integrated circuit as the served device so as to have similar physical and electrical properties as transistors within the served device to automatically and continuously measure at least one performance parameter of the served device and to produce a performance signal that is representative of the measured at least one performance parameter;

a discriminator circuit to continuously compare the performance signal to a reference signal and to produce a control signal, the discriminator circuit configured to modify one or both of the performance signal and the reference signal to enable comparison thereof; and a voltage regulating circuit to adjust the supply voltage to the served device in response to the control signal.

2. The intelligent supply voltage regulator as recited in claim 1 wherein the transistors with the served device comprise CMOS transistors.

3. The intelligent supply voltage regulator as recited in claim 1 wherein the served device, the sensing circuit and the discriminator circuit and the voltage regulating circuit are located within the same integrated circuit.

4. The intelligent supply voltage regulator as recited in claim 1 wherein the measured at least one performance parameter includes a value representing a transconductance of the transistors within the served device.

5. The intelligent supply voltage regulator as recited in claim 1 wherein the measured at least one performance parameter includes a value representing a speed performance of the served device.

6. The intelligent supply voltage regulator as recited in claim 1 wherein the sensing circuit, the discriminator circuit and the voltage regulating circuit continuously operate whereby the supply voltage is maintained at or near a voltage level related to the reference signal.

7. The intelligent supply voltage regulator as recited in claim 1 wherein the reference signal is produced by an external clock.

8. The intelligent supply voltage regulator as recited in claim 1 wherein the discriminator circuit includes a frequency discriminator.

9. The intelligent supply voltage regulator as recited in claim 1 wherein the voltage regulating circuit comprises a switched mode power regulator.

10. An intelligent supply voltage regulator to control a voltage regulating circuit that provides a supply voltage to a served device, the intelligent supply voltage regulator comprising:

a sensing circuit including transistors located on a same integrated circuit as the served device so as to have similar physical and electrical properties as transistors within the served device to continuously and automatically provide at least one performance parameter based on the supply voltage supplied to the served device and to produce a performance signal that is representative of the supply voltage provided to the served device; and a discriminator circuit to continuously compare the performance signal to a reference signal and to produce a control signal to control the voltage regulating circuit, the discriminator circuit configured to modify one or both of the performance signal and the reference signal to enable comparison thereof.

11. The intelligent supply voltage regulator as recited in claim 10 wherein the transistors within the served device comprise CMOS transistors.

12. The intelligent supply voltage regulator as recited in claim 10 wherein the discriminator circuit comprises a control circuit that produces the control circuit.

13. The intelligent supply voltage regulator as recited in claim 10 wherein the at least one performance parameter includes a value representing a transconductance of the transistors within the served device.

14. The intelligent supply voltage regulator as recited in claim 10 wherein the at least one performance parameter includes a value representing a speed performance of the served device.

15. The intelligent supply voltage regulator as recited in claim 10 wherein the sensing circuit and the discriminator circuit continuously operate to control the voltage regulating circuit whereby the supply voltage is maintained at or near a voltage level related to the reference signal.

16. The intelligent supply voltage regulator as recited in claim 10 wherein the reference signal is produced by an external clock.

17. The intelligent supply voltage regulator as recited in claim 10 wherein the sensing circuit includes a ring oscillator.

18. The intelligent supply voltage regulator as recited in claim 10 wherein the discriminator circuit includes a frequency discriminator.

19. A method for regulating a supply voltage to a served device, comprising:

independently and automatically measuring at least one performance parameter of the served device and producing a performance signal that is representative of the measured at least one performance parameter by measuring a performance parameter of transistors on a sensing circuit constructed with similar physical and electrical properties to transistors of the served device on the same integrated circuit;

continuously comparing the performance signal to a reference signal and producing a control signal and modifying one or both of the performance signal and the reference signal as necessary to enable comparing of the performance signal and the reference signal; and regulating the supply voltage to the served device in response to the control signal.

20. The method for regulating a supply voltage to a served device as recited in claim 19 wherein the measuring of the at least one performance parameter includes measuring a value representing a transconductance of a plurality of transistors on the served device.

21. The method for regulating a supply voltage to a served device as recited in claim 19 wherein the measuring of the at least one performance parameter includes measuring a value representing a speed performance of the served device.

22. The method for regulating a supply voltage to a served device as recited in claim 19 wherein the measuring, comparing, and regulating are continuously performed to maintain the supply voltage at or near a voltage level related to the reference signal.

23. A supply voltage circuit for regulating a supply voltage to a served device, comprising:

a sensing circuit fabricated of transistors on a same integrated circuit as the served device to have similar physical and electrical properties as transistors within the served device, the sensing circuit configured to measure a value representing a transconductance of the transistors within the served device and to produce a performance signal corresponding to the measured transconductance;

a discriminator circuit configured to continuously compare the performance signal to a reference signal and to produce a control signal; and a voltage regulating circuit configured to adjust the supply voltage to the served device in response to the control signal.

24. A supply voltage circuit for regulating a supply voltage to a served device, comprising:

a sensing circuit fabricated of transistors on a same integrated circuit as the served device to have similar physical and electrical properties as transistors within the served device, the sensing circuit configured to measure a value representing a speed performance of the transistors within the served device and to produce a performance signal corresponding to the measured speed performance;

a discriminator circuit configured to continuously compare the performance signal to a reference signal and to produce a control signal; and a voltage regulating circuit configured to adjust the supply voltage to the served device in response to the control signal.

25. A supply voltage circuit for regulating a supply voltage to a served device, comprising:

a sensing circuit fabricated of transistors on a same integrated circuit as the served device having similar physical and electrical properties as transistors within the served device, the sensing circuit configured to measure at least one performance parameter of the served device and to produce a performance signal that is representative of the measured at least one performance parameter;

a discriminator circuit configured to continuously compare the performance signal to a reference signal produced by an external clock and to produce a control signal; and a voltage regulating circuit configured to adjust the supply voltage to the served device in response to the control signal.

26. A supply voltage circuit for regulating a supply voltage to a served device, comprising:

a sensing circuit fabricated of transistors on a same integrated circuit as the served device having similar physical and electrical properties as transistors within the served device, the sensing circuit configured to measure at least one performance parameter of the served device and to produce a performance signal that is representative of the measured at least one performance parameter;

a discriminator circuit configured to continuously compare the performance signal to a reference signal and to produce a control signal, the discriminator circuit including a frequency discriminator; and a voltage regulating circuit configured to adjust the supply voltage to the served device in response to the control signal.

27. A supply voltage circuit for regulating a supply voltage to a served device, comprising:

a sensing circuit fabricated of transistors on a same integrated circuit as the served device having similar physical and electrical properties as transistors within the served device, the sensing circuit configured to measure at least one performance parameter of the served device and to produce a performance signal that is representative of the measured at least one performance parameter;

a discriminator circuit configured to continuously compare the performance signal to a reference signal and to produce a control signal; and a voltage regulating circuit configured to adjust the supply voltage to the served device in response to the control signal, the voltage regulating circuit comprising a switched mode power regulator.

28. A supply voltage regulator for controlling a voltage regulating circuit that provides a supply voltage to a served device, the supply voltage regulator comprising:

a sensing circuit including transistors located on a same integrated circuit as the served device and having similar physical and electrical properties as transistors within the served device, the sensing circuit configured to provide a value representing a transconductance of the transistors within the served device and to produce a performance signal correlating to the provided value representing the transconductance; and a discriminator circuit configured to compare the performance signal to a reference signal and to produce a control signal to control the voltage regulating circuit.

29. A supply voltage regulator for controlling a voltage regulating circuit that provides a supply voltage to a served device, the supply voltage regulator comprising:

a sensing circuit including transistors located on a same integrated circuit as the served device and having similar physical and electrical properties as transistors within the served device, the sensing circuit configured to provide a value representing a speed performance of the transistors within the served device and to produce a performance signal correlating to the provided value representing the speed performance; and a discriminator circuit configured to compare the performance signal to a reference signal and to produce a control signal to control the voltage regulating circuit.

30. A supply voltage regulator to control a voltage regulating circuit that provides a supply voltage to a served device, the supply voltage regulator comprising:

a sensing circuit including transistors located on a same integrated circuit as the served device so as to have similar physical and electrical properties as transistors within the served device, the sensing circuit configured to provide at least one performance parameter based on the supply voltage supplied to the served device and to produce a performance signal that is representative of the supply voltage provided to the served device; and a discriminator circuit configured to compare the performance signal to a reference signal produced by an external clock and to produce a control signal to control the voltage regulating circuit.

31. A supply voltage regulator to control a voltage regulating circuit that provides a supply voltage to a served device, the supply voltage regulator comprising:

a sensing circuit including a ring oscillator with transistors located on a same integrated circuit as the served device so as to have similar physical and electrical properties as transistors within the served device, the sensing circuit configured to provide at least one performance parameter based on the supply voltage supplied to the served device and to produce a performance signal that is representative of the supply voltage provided to the served device; and a discriminator circuit configured to compare the performance signal to a reference signal and to produce a control signal to control the voltage regulating circuit.

32. A supply voltage regulator to control a voltage regulating circuit that provides a supply voltage to a served device, the supply voltage regulator comprising:

a sensing circuit including transistors located on a same integrated circuit as the served device so as to have similar physical and electrical properties as transistors within the served device, the sensing circuit configured to provide at least one performance parameter based on the supply voltage supplied to the served device and to produce a performance signal that is representative of the supply voltage provided to the served device; and a discriminator circuit, the discriminator circuit including a frequency discriminator, and the discrimminator circuit configured to continuously compare the performance signal to a reference signal and to produce a control signal to control the voltage regulating circuit.

33. A method for regulating a supply voltage to a served device, comprising:

independently and automatically measuring at least one performance parameter of the served device and producing a performance signal that is representative of the measured at least one performance parameter, the measuring of the at least one performance parameter includes measuring a value representing a transconductance of a plurality of transistors, on a sensing circuit of an integrated circuit, having similar physical and electrical properties to transistors of the served device on the same integrated circuit;

continuously comparing the performance signal to a reference signal and producing a control signal; and regulating the supply voltage to the served device in response to the control signal.

34. A method for regulating a supply voltage to a served device, comprising:

independently and automatically measuring at least one performance parameter of the served device and producing a performance signal that is representative of the measured at least one performance parameter, the measuring of the at least one performance parameter includes measuring a value representing a speed performance of a plurality of transistors, on a sensing circuit of an integrated circuit having similar physical and electrical properties to transistors of the served device on the same integrated circuit;

continuously comparing the performance signal to a reference signal and producing a control signal; and regulating the supply voltage to the served device in response to the control signal.

* * * * *